United States Patent [19]

Collins

[11] 4,150,761

[45] Apr. 24, 1979

[54] BOTTLE CLOSURE-CUP ASSEMBLY

[75] Inventor: Herbert Collins, Fort Lee, N.J.

[73] Assignee: Schenley Industries, Inc., New York, N.Y.

[21] Appl. No.: 815,345

[22] Filed: Jul. 13, 1977

[51] Int. Cl.[2] ..... B65D 51/24

[52] U.S. Cl. ..... 215/228; 141/380; 215/DIG. 7

[58] Field of Search ..... 215/226, 227, 228, DIG. 7, 215/334; 206/217; 220/212, 90.2; 141/379, 380, 381, 21, 22

[56] References Cited

U.S. PATENT DOCUMENTS

| | | | |
|---|---|---|---|
| 3,159,298 | 12/1964 | Saw | 215/228 |
| 3,219,222 | 11/1965 | Davidson | 215/334 |
| 3,249,248 | 5/1966 | Metzendorf | 215/334 |
| 3,942,667 | 3/1976 | Thomas | 215/334 X |

FOREIGN PATENT DOCUMENTS

| | | | |
|---|---|---|---|
| 264123 | 7/1963 | Australia | 215/334 |

*Primary Examiner*—Donald F. Norton
*Attorney, Agent, or Firm*—Blum, Moscovitz, Friedman & Kaplan

[57] ABSTRACT

A cup for use with a bottle to cover a threaded bottle cap having a roughened outer surface is formed with a plurality of inwardly projecting ribs which force-fit into engagement with the roughened surface of the bottle cap. At least two of the ribs are formed with a projecting seat for securing over the bottle cap. When the cup is seated in position on the bottle cap, the cup and bottle cap may be rotatably displaced as a unit to unscrew the bottle cap from the bottle. The cup can be separated from the bottle cap while the bottle cap remains on the bottle by pulling the cup away from the bottle cap, thereby allowing the bottle cap to be removed separately from the bottle.

11 Claims, 5 Drawing Figures

BOTTLE CLOSURE-CUP ASSEMBLY

BACKGROUND OF THE INVENTION

This invention relates generally to a cup for use with a bottle, and in particular to a bottle closure cup which fits over a threaded bottle cap and which may be removed independently or in combination with the bottle cap.

Various closure cups for a container and cap assembly employing a cup are known in the art. For example, closure cups often are secured releasably on the top of a decanter or a vacuum or insulated bottle assembly. One such assembly is shown in U.S. Pat. No. 2,584,522 to S. J. Wolf, wherein a cup fits snugly about a gasket secured to the neck of a container. In a typical vacuum bottle assembly the cup is secured to the bottle assembly by a separate thread assembly formed about the bottle neck or a locking mechanism which secures the cup about the neck of the container. In these cases, both the cup and the cap cannot be removed in a single operation. The cup is removed independently from the separately secured bottle cap used to close the bottle. When it is desired to open the bottle in these assemblies, the cup must be removed first, and then the bottle cap may be removed. However, often it is desirable to remove both the cup and the bottle cap as a unit in order to reach the contents of the bottle. In addition, the cup must be sized for a particular bottle and neck and is not interchangeable with other bottle sizes even if the bottle cap is interchangeable.

SUMMARY OF THE INVENTION

Generally speaking, in accordance with the invention, a cup for use with a bottle to cover a rotatably openable bottle cap having a roughened outer surface is provided. The cup may be removed independently from the bottle cap or removed in combination with the bottle cap as a unit. A cup constructed and arranged in accordance with the invention includes a cup formed with a plurality of inwardly facing ribs which force-fit into engagement with the roughened surface of the bottle cap. At least two of the ribs are formed with a seat for securing over the top of the bottle cap. When the cup is in position secured to the bottle cap, the cup and bottle cap may be rotatably displaced as a unit to unscrew the bottle cap from the bottle. If desired, the cup can be separated from the bottle cap while the bottle cap remains on the bottle by pulling the cup away from the bottle allowing the cap to be removed separately.

Accordingly, it is an object of this invention to provide an improved cup for use with a bottle.

Another object of the invention is to provide an improved cup for use with a bottle which secures to a bottle cap on the bottle.

A further object of the invention is to provide an improved bottle cup for use with a bottle which is removable separately from a bottle cap.

Still another object of the invention is to provide an improved cup for use with a bottle which may be removed from the bottle with a bottle cap as a unit.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
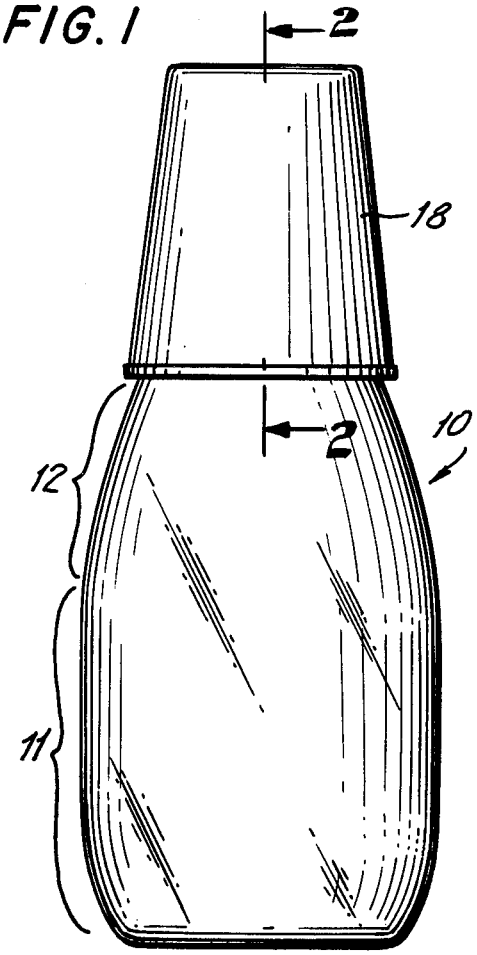
FIG. 1 is a side elevational view of a bottle with a cup arranged in accordance with the invention.
Figure 2:
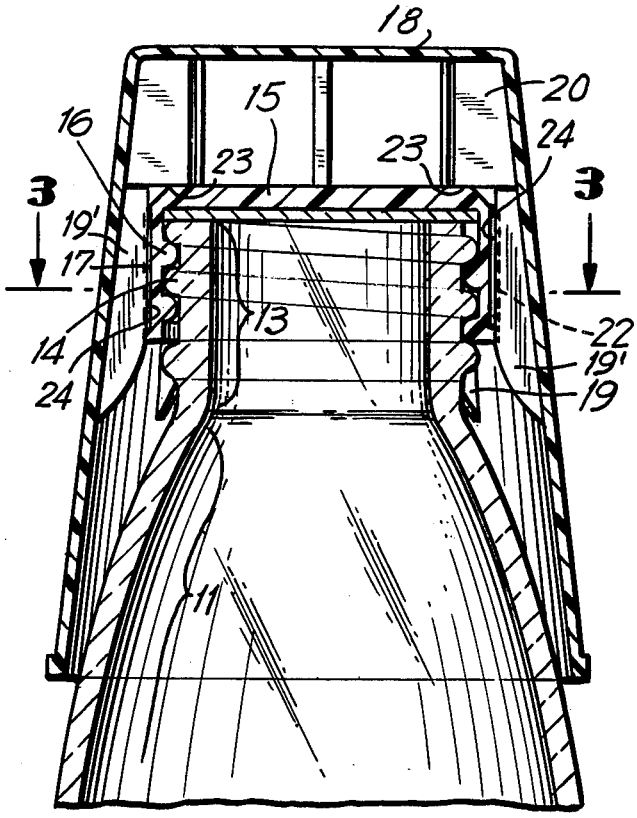
FIG. 2 is a cross-sectional view of the cup and bottle cap on the bottle taken along line 2—2 of FIG. 1.

Referring now to FIG. 1 and FIG. 2, a bottle indicated generally as 10 having a substantially cylindrical lower portion 11, a substantially frusto-conical upper portion 12 and a cylindrical neck portion 13 with a thread 14 on the outer surface is shown. A bottle cap 15 having a receiving thread 16 and an axially ribbed outer surface 17 is secured rotatably on bottle neck 13. A cup 18, constructed and arranged in accordance with the invention, is shown in engagement with bottle cap 15.

Cup 18 is substantially frusto-conical in shape and of a size to fit over bottle cap 15 and extend over a part of bottle upper portion 11. Cup 18 is formed with a plurality of inwardly facing ribs 19 which force-fit into engagement with the grooves 21 between ribs 22 on surface 17 of bottle cap 15. Cup 18 is formed further with at least two ribs 19' (four in the embodiment depicted in the drawings) each having a seat 20 extending over bottle cap 15 for regulating the axial position of cup 18 on bottle cap 15. Rib seats 20 are defined by a cut-out region in ribs 19' having a first edge 23 extending substantially parallel to the top surface of bottle cap 15 for engagement with at least a portion of said top surface of bottle cap 15 and a second edge 24 extending at least in part parallel with surface 17 of bottle cap 15 for force-fit engagement in a groove 21 in surface 17 of bottle cap 15. By providing at least two ribs 19' with rib seats 20, cup 18 fits over bottle cap 15 until seats 20 come into engagement with the top surface of bottle cap 15.

Figure 3:
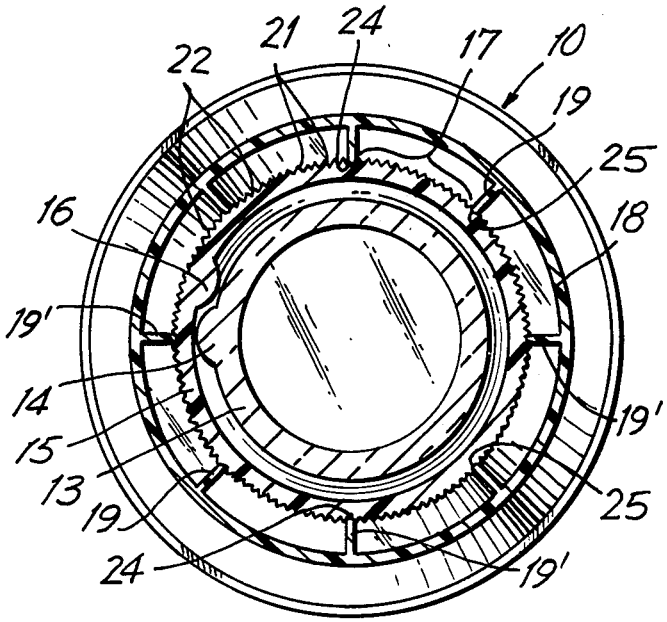
FIG. 3 is a cross-sectional view of the cup and bottle cap on the bottle taken along line 3—3 of FIG. 2.
Figure 5:
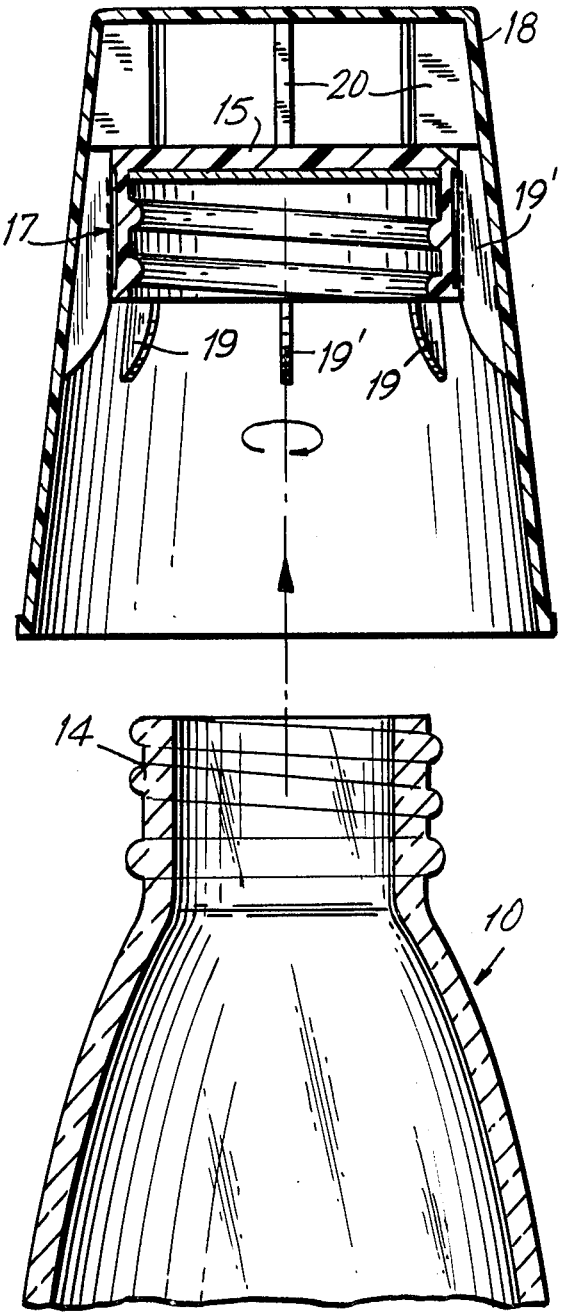
FIG. 5 is an exploded, cross-sectional view showing the cup and screw cap removed from the bottle as a unit.

As shown in FIG. 3, ribs 19 also each formed with an axially extending edge 25 which engages in a groove 21 on surface 17 of bottle cap 15. Ribs 19 and 19', by engaging in grooves 21, permit cup 18 and bottle cap 15 to be rotatably displaced (normally in the counter-clockwise direction) as a unit to unscrew bottle cap 15 from bottle 10 as shown in FIG. 5. Similarly, cup 18 and bottle cap 15 may be rotated onto bottle 10 as a unit by rotating in the clockwise direction.

Figure 4:
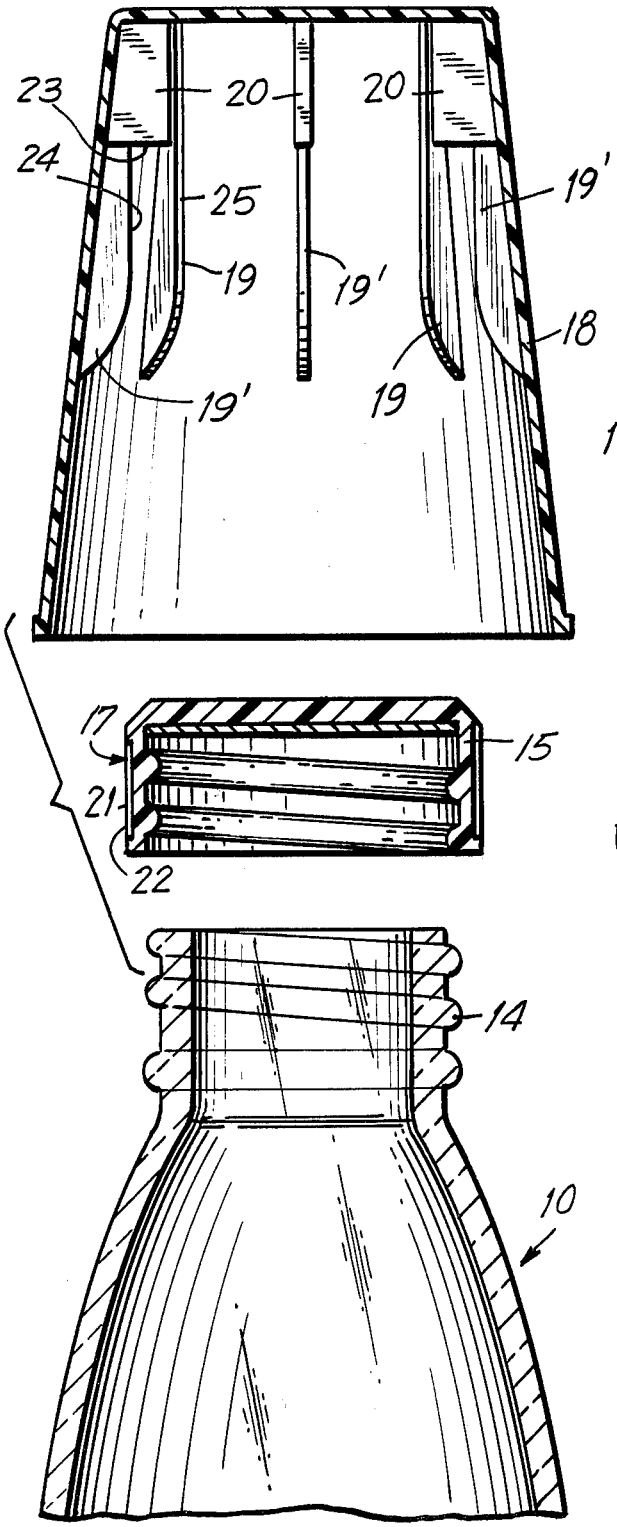
FIG. 4 is an exploded, cross-sectional view showing the cup and bottle cap removed independently from the bottle of FIG. 2.

Alternatively cup 18 may be removed from engagement with bottle cap 15 prior to removing bottle cap 15 by pulling cup 18 away from bottle 10 in the axial direction. Bottle cap 15 may then be removed separately by rotatably displacing bottle cap 15 from bottle 10. This removal sequence results in an individual cup 18, bottle cap 15 and bottle 10 as depicted in FIG. 4, and allows cup 18 to be used as a receptacle for the contents of bottle 10.

Bottle 10 and bottle cap 15 may be formed from glass, metal, plastic or any other suitable material. Similarly, cup 17 may be formed from glass or a plastic material, such as, polyethylene, polypropylene or any other rigid plastic material, metal or other suitable material which can be formed into the desired shape with ribs 19 which can fit into engagement with knurled portion 17 of bottle cap 15. The surface 17 of bottle cap 15 may be knurled or otherwise roughened for cooperation with ribs 19 and 19'.

Accordingly, by constructing and arranging a cup with a plurality of ribs, at least two of which are formed with seats for securing over the top of a threaded bottle cap, the cup and bottle cap may be rotatably displaced as a unit to unscrew the cap from the bottle. Alternatively, the cup can be separated from the bottle merely by pulling up and away from the bottle cap thereby providing a closure cup which may be used for receiving the contents of the bottle.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A bottle closure-cup assembly comprising a rotatably removable bottle cap and a cup formed with a base, a rim, a rigid peripheral wall extending continuously from said base to said rim and inwardly projecting means for engaging with said bottle cap, said bottle cap formed with coupling means formed on the outer peripheral surface thereof for coupling engagement with said projecting means, the peripheral wall of said cup being spaced apart from said bottle cap when in said coupling engagement for defining a cup of a volumetric dimension substantially greater than said cap, whereby said cup and bottle cap may be rotatably displaced as a unit to remove said bottle cap from the bottle and whereby said cup can be separated from said bottle cap by pulling said cup away from said bottle without rotating said bottle cap.

2. The bottle closure-cup assembly of claim 1, wherein said projecting means on said cup is a plurality of inwardly facing ribs.

3. The bottle closure-cup assembly of claim 2, wherein at least a portion of said ribs are formed with an inner edge extending substantially parallel to the peripheral surface of said cap.

4. The bottle closure-cup assembly of claim 2, wherein said coupling means is a roughened region on said peripheral surface of said cap.

5. The bottle closure-cup assembly of claim 4, wherein said roughened region includes a plurality of spaced ribs projecting from the peripheral surface of said cap and extending substantially parallel to said cup ribs, said cap ribs define grooves therebetween for receipt of said cup ribs.

6. The bottle closure-cup assembly of claim 2, wherein at least two of said cup ribs are formed with seating means for regulating the axial position of said cup on said bottle cap.

7. A bottle closure-cup assembly comprising a rotatably removable bottle cap and a cup formed with a plurality of inwardly facing ribs for engaging with said bottle cap, said bottle cap formed with coupling means on the outer peripheral surface thereof for coupling engagement with said ribs, at least two of said cup ribs formed with a projection extending inwardly from said ribs to extend over at least a portion of the top surface of said bottle cap, whereby said cup and bottle cap may be rotatably displaced as a unit to remove said bottle cap from the bottle and whereby said cup can be separated from said bottle cap by pulling said cup away from said bottle without rotating said bottle cap.

8. The bottle closure-cup assembly of claim 7, wherein said cup is formed with eight equally-spaced ribs.

9. The bottle closure-cup assembly of claim 8, wherein two alternative pairs of said ribs are formed with said seating means.

10. The bottle closure-cup assembly of claim 9, wherein said ribs extend radially from the side wall of said cup.

11. The bottle closure-cup assembly of claim 10, wherein said cup is frusto-conical in shape.

* * * * *